United States Patent [19]

Aliment et al.

[11] 4,088,294

[45] May 9, 1978

[54] MULTIPURPOSE BRACKET

[76] Inventors: Lindy Aliment, 7030 S. 129th Pl., Seattle, Wash. 98178; Manio L. Phillips, 613 S. 16th, Renton, Wash. 98055

[21] Appl. No.: 745,080

[22] Filed: Nov. 26, 1976

[51] Int. Cl.[2] ..... A47G 33/12

[52] U.S. Cl. ..... 248/519; 248/529; 248/313; 248/247

[58] Field of Search ..... 248/529, 519, 248, 300, 248/310, 313, 247, 243, 222.4

[56] References Cited

U.S. PATENT DOCUMENTS

| | | | |
|---|---|---|---|
| 1,520,218 | 12/1924 | Barnard | 248/300 |
| 1,528,268 | 3/1925 | Schlegel | 248/247 |
| 1,579,556 | 4/1926 | McKenzie | 248/248 |
| 1,856,044 | 4/1932 | Stowell | 248/247 |
| 1,861,100 | 5/1932 | Stanitz | 248/247 X |
| 2,327,403 | 8/1943 | Coupanger | 248/529 X |
| 2,853,261 | 9/1958 | Loed | 248/529 X |
| 2,877,976 | 3/1959 | Massari | 248/313 |
| 3,339,868 | 9/1967 | Ehrens | 248/300 X |

FOREIGN PATENT DOCUMENTS

| | | | |
|---|---|---|---|
| 89,994 | 7/1957 | Norway | 248/247 |

*Primary Examiner*—Francis K. Zugel

*Attorney, Agent, or Firm*—Robert W. Beach; Ward Brown

[57] ABSTRACT

A multipurpose bracket includes two legs disposed substantially perpendicular to each other. The legs may be directly connected or may be joined by an intermediate connecting portion. Such connecting portion may be flat and inclined relative to the two legs or may be arcuate and disposed convexly towards the free ends of the legs. One leg has spaced keyhole apertures for demountably securing the bracket to a wall, fence, or door and a band-receiving slot located between such apertures and extending transversely of such leg. The other leg may also have spaced keyhole apertures. Such brackets can be used, for example, as supports for shelves, fishing poles, skis, or lumber; as hangers for ladders, hoses, clothes, or hanging baskets; or as shoe scrapers. The transverse slots receive bands or straps for securing or embracing articles supported by the brackets. Three or more brackets can be interconnected by a circumferentially-adjustable band threaded through the band-receiving slots with the unslotted legs of the brackets disposed substantially coplanar, whereby such brackets may be used as a support for a Christmas tree, a pole or a post.

1 Claim, 12 Drawing Figures

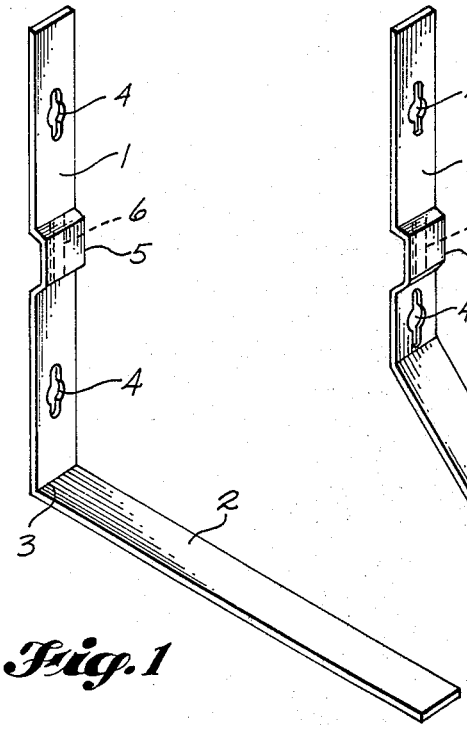
Fig. 1
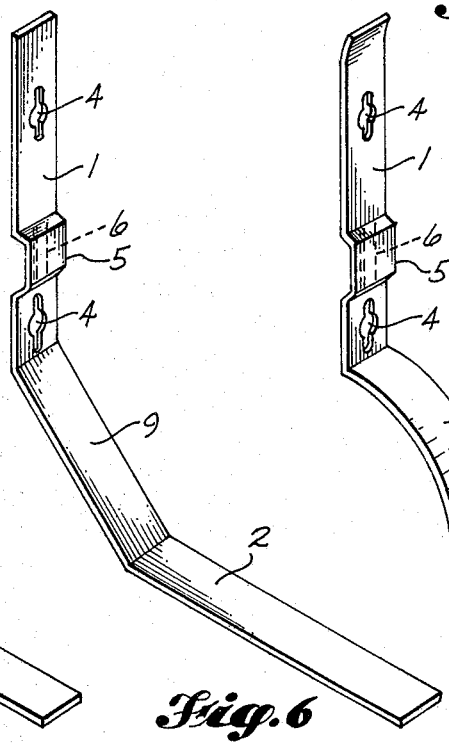
Fig. 6
Fig. 5
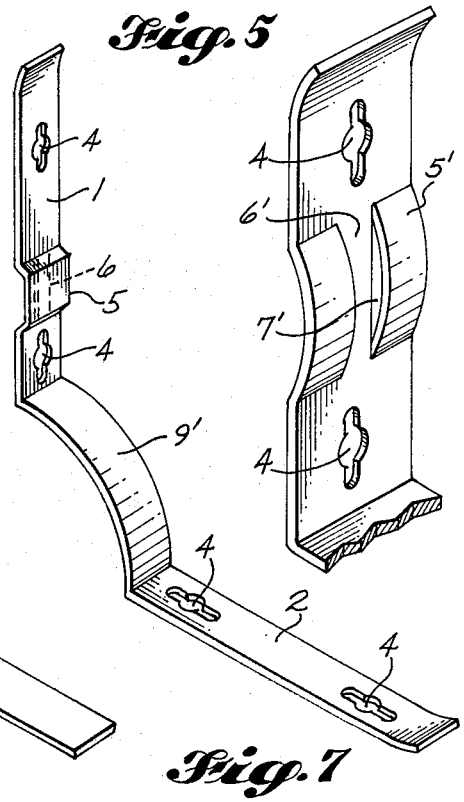
Fig. 7
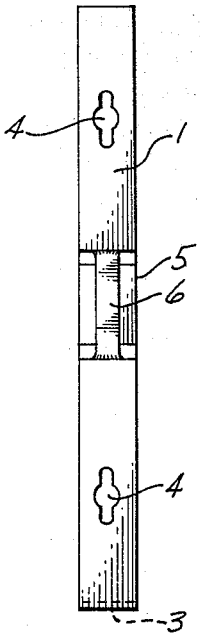
Fig. 2
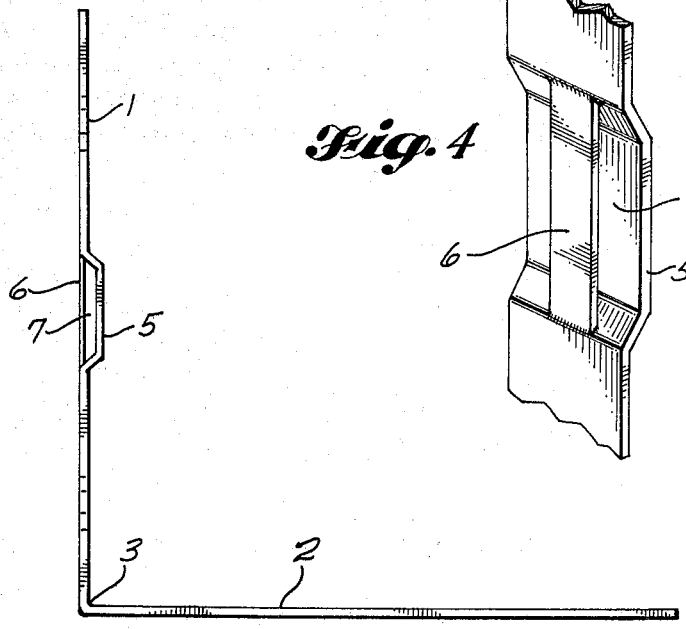
Fig. 3
Fig. 4
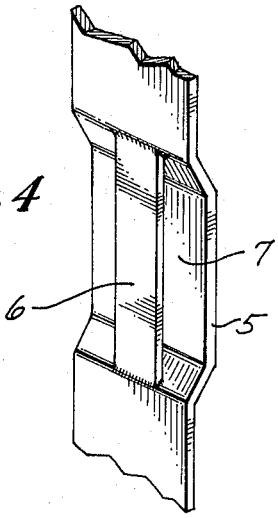

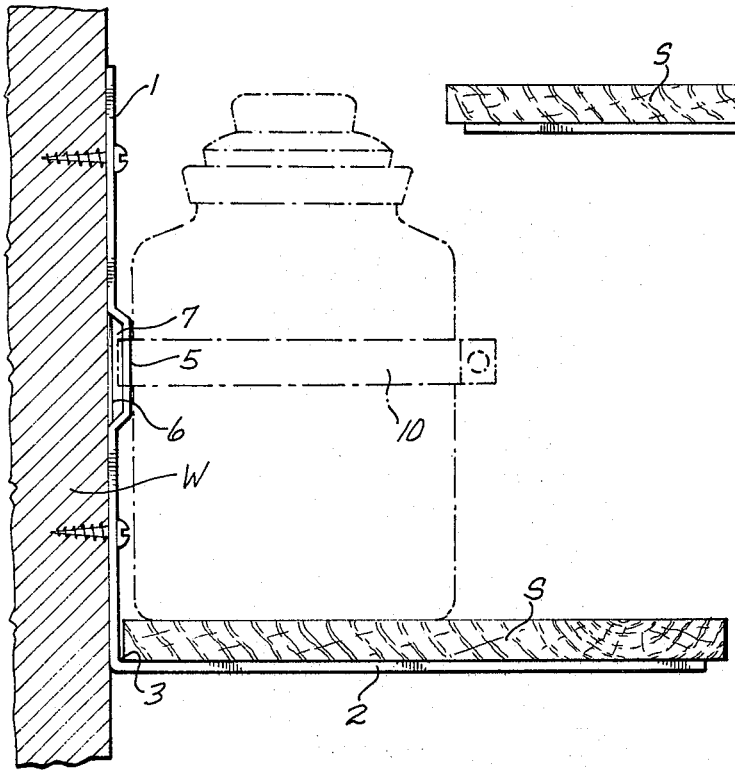
Fig. 8
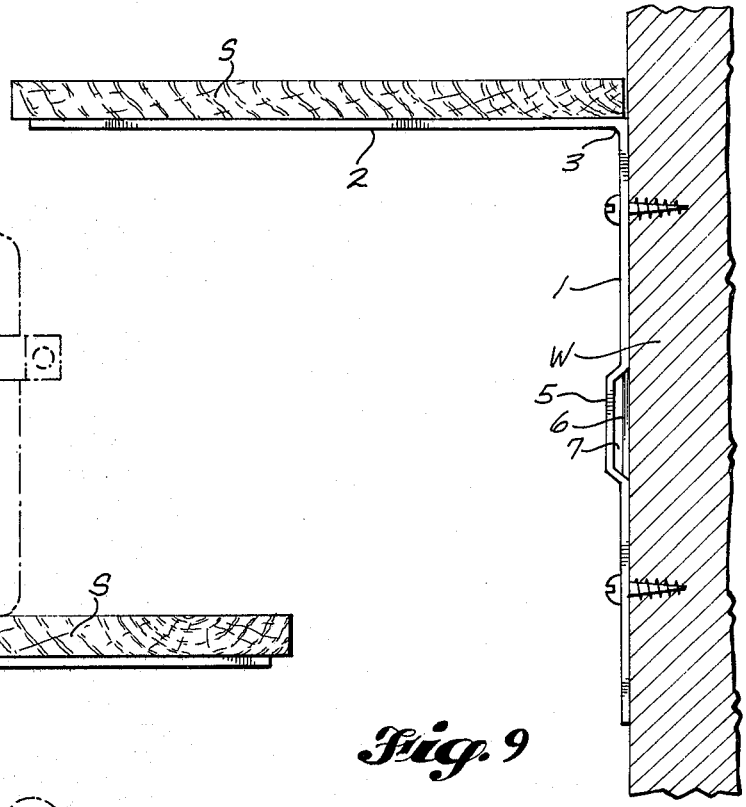
Fig. 9
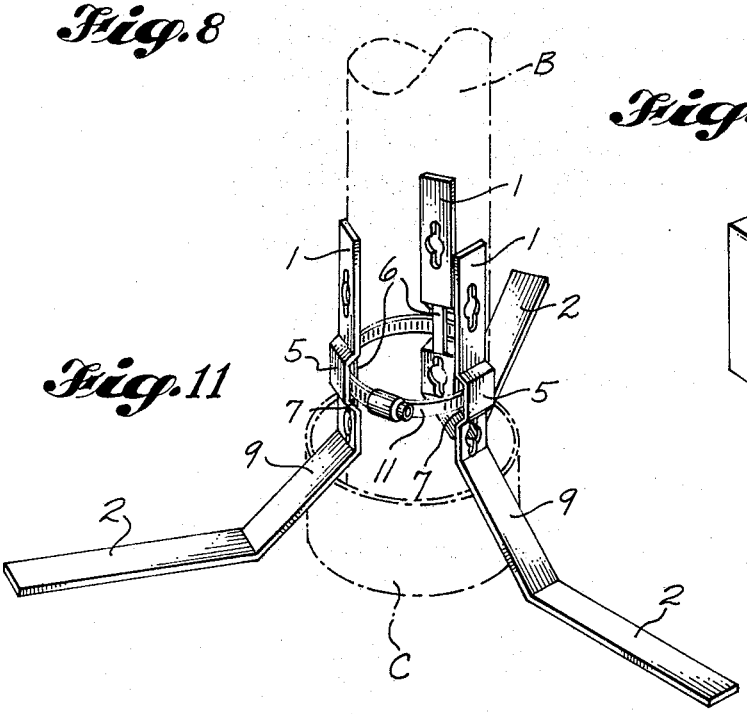
Fig. 11
Fig. 10
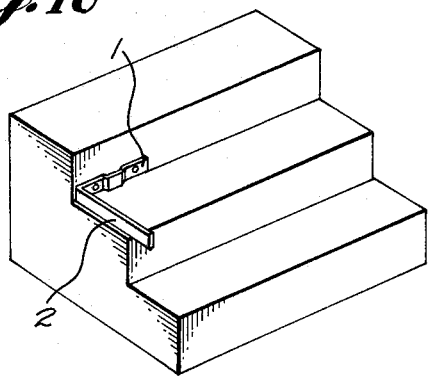
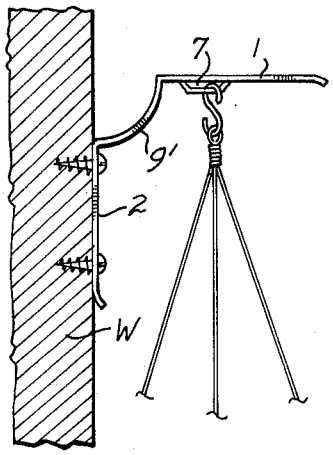
Fig. 12

MULTIPURPOSE BRACKET

BACKGROUND OF THE INVENTION

1. Field of the Invention

The present invention relates to brackets for mounting supports, interconnecting structural components, or supporting articles freestanding.

2. Prior Art

Christmas tree supports are shown in various United States patents. The support of U.S. Pat. No. 3,733,040 contains many component parts making the support difficult to assemble and expensive to manufacture. The legs of the support of U.S. Pat. No. 1,319,009 are of a particularly complex shape making it another expensive support. U.S. Pat. No. 3,295,802 shows two pairs of legs held in engagement with opposite sides of the base of a tree by a band. However, the trunks of large trees are engaged only by the edges of leg angles, the band is held on the legs only by tension, and the floor or other supporting surface is engaged only by small feet. In addition, all three of these suppots preclude placing the base of a supported tree in a container of water without placing at least part of the support itself in such container. Hence, either these supports will be subject to corrosion or rot from exposure to water or the supported trees will be denied water, have shortened useful lives, and be more likely to become fire hazards.

The support in U.S. Pat. No. 2,327,403 relies on short pins extending into the base of a tree to support the weight of the tree. Such support could support stably only a very small tree. U.S. Pat. No. 2,853,261 shows a "Stabilizer for Containers" using a complicated resilient band holding legs in engagement with a cylinder which is to receive the container to be supported. This device shares with all the above noted christmas tree supports the problem of being designed for a single use.

SUMMARY OF THE INVENTION

It is an object of the present invention to provide brackets adaptable to a variety of uses.

More specifically, it is an object to provide brackets which can function as supports for shelves, fishing poles, skis, or lumber; hangers for ladders, hoses, clothes, or hanging baskets; freestanding article supports; or shoe scrapers.

Another object is to provide such brackets which can easily be secured, unsecured, and resecured to a wall, fence, or door.

A further object is to provide a Christmas tree support, which allows the base of the supported tree to be received in a container of water without placing any portion of the support itself in such container.

Another object is to provide a Christmas tree support, the component parts of which can be adapted to other uses.

An additional object is to provide multipurpose brackets which are of simple and inexpensive construction.

The foregoing objects can be accomplished by providing a set of brackets in which each bracket includes two legs which are substantially mutually perpendicular. One of the legs includes keyhole apertures spaced lengthwise of the leg and a band-receiving slot located between such apertures and extending transversely of such leg. The other leg may also include keyhole apertures. A bracket can be secured to a wall by screws extending through the keyhole apertures for holding the outer face of a first leg in firm engagement with the wall. In this arrangement the second leg projects substantially perpendicularly from the wall and articles can be supported by or suspended from the projecting second leg. Two or more brackets can be secured to a wall in this manner in horizontal alignment and the projecting second legs used to support a shelf.

An article can be supported freestanding by three or more brackets interconnected by a circumferentially-adjustable band threaded through the band-receiving slots and encircling the article base. The bond can be tightened, bringing the slotted legs into engagement with the periphery of the article base, with the lengths of such legs extending substantially parallel to the axis of the base, and with the unslotted legs being substantially coplanar and extending radially of the base. Such interconnected brackets can be used as a support for a Christmas tree, a pole or a post. The legs of each bracket may be connected by an arcuate or inclined portion to provide space between the brackets for receiving a water container into which the base of the Christmas tree can project.

BRIEF DESCRIPTION OF THE DRAWINGS

FIG. 1 is a top perspective of a multipurpose bracket in accordance with the present invention.

FIG. 2 is a rear elevation and FIG. 3 a side elevation of the bracket of FIG. 1.

FIG. 4 is a fragmentary perspective of the bracket of FIGS. 1, 2 and 3, and FIG. 5 is a corresponding fragmentary perspective of a modified bracket.

FIG. 6 is a top perspective of a modified multipurpose bracket, and FIG. 7 a top perspective of another modified multipurpose bracket.

FIGS. 8 and 9 are side elevations of the bracket of FIG. 1 showing alternative mounting attitudes for use as a shelf support.

FIG. 10 is a top perspective of the bracket of FIG. 1 mounted for use as a shoe scraper.

FIG. 11 is a top perspective of a plurality of brackets of the type shown in FIG. 6 interconnected to support an article free standing, with the article base and a water container shown in phantom.

FIG. 12 is a side elevation of the bracket of FIG. 7 mounted for use as a hanger.

DETAILED DESCRIPTION

The form of multipurpose bracket shown in FIGS. 1, 2 and 3 includes two legs 1 and 2 connected by a substantially right angle bend 3. The face of each leg remote from the free end of its companion leg will be referred to as the "outer" face. One of the legs, leg 1, includes a pair of keyhole apertures 4 spaced apart lengthwise of the leg. As best seen in FIG. 2, each aperture 4 includes a circular central portion and a slot extending longitudinally of leg 1 from each end of a diameter of the circular portion. The transverse width of each slot is less than the diameter of the circular aperture portion.

As best seen in FIG. 4, leg 1 also includes intermediate its ends an offset portion 5 forming an outwardly opening transverse channel. The channel web therefore is spaced inwardly from the plane of the leg. A bridging strip 6, extending longitudinally of the leg and substantially coplanar therewith, has its ends welded to the respective flanges of the channel, thereby forming with the channel web a transverse band-receiving slot 7.

FIG. 5 shows a modified band-receiving slot 7'. Leg 1 is provided with two parallel longitudinal slits. The opposite leg margins alongside the slits are pressed inward fron the plane containing the leg to form offset portions 5'. The leg portion between the slits remains coplanar with the leg and forms a bridging strip 6'. The band-receiving slot 7' is defined by bridging strip 6' and marginal offset portions 5'. Such slot is preferred because it allows the bracket to be stamped from a single strip of material and eliminates the welding or bonding step in the manufacturing process required to attach the bridging strip 6 shown in FIG. 4.

Each of the brackets shown in FIGS. 6 and 7 has an intermediate connecting portion 9 or 9' joining the adjacent ends of legs 1 and 2. In FIG. 6 the connecting portion 9 is a flat strip and is inclined relative to legs 1 and 2, respectively. In FIG. 7 the connecting portion 9' is an arcuate strip and is disposed convexly toward the free ends of legs 1 and 2, the chord of the arc being inclined relative to the two legs, respectively. The bracket in FIG. 7 is further modified by including legs whose free end portions are curved slightly inward and by including keyhole apertures 4 in leg 2 as well as in leg 1.

FIGS. 8 and 9 show the multipurpose bracket of FIGS. 1 to 3 in representative uses as shelf supports. In each figure leg 1 is secured to a wall W by screws extending through the keyhole apertures. The heads of the mounting screws are small enough to pass through the central hole of the keyhole apertures yet not so small as to be capable of passing through the aperture slots. The outer face of leg 1 engages the wall and extends substantially vertically. If the bracket is shifted upward to a position where the screw heads are centered in the central holes of the keyhole apertures 4, the bracket can be disengaged from the wall without removing the screws. Similarly, the bracket can be resecured by slipping the central holes of the apertures over the screw heads and sliding the bracket downward until the screw shanks are received in the narrower aperture slots.

In FIGS. 8 and 9, leg 2 of the bracket projects substantially perpendicularly from the wall. In FIG. 8 leg 1 is shown as extending upward from leg 2, and a shelf S is supported by the inner face of leg 2. FIG. 9 shows the opposite orientation with leg 1 extending downward from leg 2 and a shelf S supported by the outer face of leg 2. The orientation of FIG. 8 may be preferable because, as shown in that figure, when leg 1 extends upward from leg 2 the band-receiving slot 7 is disposed above the shelf where a metal strap 10 for securing articles stored on the shelf can be threaded through the slot. Alternatively, a flexible strap, for example a length of cord or wire, could be substituted for the metal strap 10.

If both legs have apertures 4, as shown in FIG. 7, the shelf can be secured to the projecting legs by screws or nails. Such screws or nails can be located on the shelf bottom to pass through the enlarged portions of the slots and the shelf can then be slid edgewise to move the screws or nails into slotted portions of the apertures so the shelf cannot be lifted up. The shelf can, however, be removed at will without the necessity of removing the screws or nails simply by shifting it edgewise until the heads of the screws or nails again are in registration with the enlarged central portions of the apertures. The shelf can then be lifted and removed.

Two or more multipurpose brackets can be secured to a wall or fence in the manner described above and used without a shelf to support, for example, fishing poles, skis, or lumber. A single bracket could be used as a hanger whereby a hose, ladder, or hanging basket could be suspended from the projecting leg. Another use is shown in FIG. 10. There a bracket has been secured to a riser between two stair treads. Leg 1 of the bracket extends substantially horizontally with its outer face engaging the riser and one longitudinal edge engaging the lower stair tread. Leg 2 extends along one end of the tread. A bracket mounted in this fashion provides a handy shoe scraper.

FIG. 11 shows a plurality of multipurpose brackets being used as a support for an article with a substantially cylindrical base B, shown in phantom, supported in an upright position. Three brackets disposed substantially equiangularly around the base are interconnected by a circumferentially-adjustable band 11 threaded through the band-receiving slots 7 in legs 1. The base B of the article to be supported is inserted between the legs 1 so that such legs extend substantially parallel to the axis of the base and band 11 encircles such base. The band is then tightened to draw legs 1 into firm engagement with the base.

It is preferred that the bridging strips 6 be narrower than legs 1 so that the band itself engages the base throughout most of the length of the band. The bracket legs 2 project radially outward relative to base B and are substantially coplanar. When band 11 is tightened, legs 2 should be disposed in a plane slightly below the bottom of base B so such legs will engage the floor or other supporting surface. Because legs 1 extend upward a substantially distance above slots 7 and are held in firm engagement with base B, a particularly stable support is provided.

The brackets can be further secured to the base and the base supported by the brackets by driving nails or screws into the base at proper locations. The central portions of the apertures 4 can then be fitted over the heads of the screws or nails and the base can be slid down to fit the shanks of the screws or nails in the slots extending downward from the central portions of the apertures. This arrangement of three or more brackets in combination with an adjustable band provides an effective support for a Christmas tree, a pole or a post. It has been found that brackets made of band iron ⅛ inch thick and one inch wide and having legs 9 or 10 inches long will support stably a nine-foot Christmas tree. Much larger trees could be supported if brackets with longer legs and, perhaps, more than one band-receiving slot were provided.

Since each of the brackets in FIG. 11 includes an intermediate connecting portion 9 which is inclined relative to the two legs, respectively, the lower end of a Christmas tree base can extend below legs 1. The connecting portions provide space below legs 1 for a small water container C into which the tree base can project. Space for a larger water container will be provided if brackets including an arcuate connecting portion, like the bracket in FIG. 6, are used. Other preferable features are shown in FIG. 6. The inwardly curved free ends of the legs will prevent gouging of an article base as the base is inserted between interconnected legs 1 and will prevent the radially projecting legs 2 from biting into or marring the floor or other supporting surface. The keyhole apertures 4 in the legs 2 permit the interconnected brackets to be secured to a supporting surface, for example, a separate piece of plywood interposed between such legs and the floor, making the article support even more sturdy.

The curved free ends are also preferable if a multipurpose bracket is to be used as a hanger mounted as shown in FIG. 8 to deter the cord or wire suspending a hanging basket, for example, from slipping over the free end of the projecting leg. Alternatively, as shown in FIG. 12, such cord or wire could be carried by a hook which is threaded through the band-receiving slot of a bracket secured to a wall by screws extending through the additional apertures in leg 2.

If brackets having a connecting portion 9 or 9' as shown in FIG. 5 or FIG. 6 are used to support a shelf, they can be disposed with the wall-engaging legs extending below the shelf-supporting legs (i.e. the orientation of FIG. 9) so that the connecting portions are inclined downwardly from the projecting legs supporting the shelf to provide greater strength as well as a decorative effect. Such brackets could be mounted in the orientation of FIG. 8 and the shelf S notched at the location of connecting portions 9 or 9', or a narrower shelf could fit between the connecting portions and the curved free ends of the shelf-supporting legs.

We claim:

1. A support for maintaining an elongated article freestanding in upright position on a substantially horizontal supporting surface comprising at least three brackets spaced circumferentially around the base of the article, each of said brackets having:

a first leg disposed with its length extending substantially longitudinally of the elongated article;

a second leg disposed substantially perpendicular to said first leg;

said first and second legs being longer than they are wide and wider than they are thick;

a plane parallel to the width of each leg being perpendicular to the other leg;

said first leg having a flat back engaging the longated article;

an intermediate portion at a location spaced a substantial distance from said second leg projecting generally toward said second leg; and a thin flat portion bridging said projecting intermediate portion and forming therewith a band-receiving slot extending transversely of said first leg and parallel to the width of said flat portion and to the width of said first leg;

a circumferentially-adjustable bendable band threaded through said band-receiving slots of all of said brackets, encircling the article and holding the flat backs of said first legs in engagement with the elongated article for supporting the same;

said thin flat bridging portion of each first leg having a planar surface remote from said second leg at the region of said band-receiving slot which is substantially coplanar with the flat back of said first leg beyond said band-receiving slot in both directions, making the substantially flat back continuous lengthwise of said first leg so that said circumferentially-adjustable band will engage the article close to the edges of the thin flat bridging portions and the major portion of the band length next to the article will engage the article contiguously;

said second legs being disposed in substantially mutually coplanar relationship and having their lengths projecting substantially radially outward relative to the elongated article and their widths parallel to the supporting surface; and means for exerting lengthwise tension on said band for shortening said band circumferentially and thereby constricting it by sliding it through the band-receiving slots of a plurality of said brackets to draw the flat backs of said first legs into firm engagement with the elongated article.

* * * * *